United States Patent [19]
Yamada et al.
[11] Patent Number: 4,473,398
[45] Date of Patent: Sep. 25, 1984

[54] METHOD FOR DESULFURIZING A MOLTEN IRON BY INJECTION

[75] Inventors: Sumio Yamada, Ichikawa; Fumio Sudo; Hitoshi Morishita, both of Chiba, all of Japan

[73] Assignee: Kawasaki Steel Corporation, Kobe, Japan

[21] Appl. No.: 532,600

[22] Filed: Sep. 15, 1983

[30] Foreign Application Priority Data

Sep. 22, 1982 [JP] Japan ..... 57-165591

[51] Int. Cl.[3] ..... C21C 7/02
[52] U.S. Cl. ..... 75/58; 75/52; 75/53; 75/257
[58] Field of Search ..... 75/52, 53, 58, 257

[56] References Cited

U.S. PATENT DOCUMENTS 3,853,540 12/1974 Schlatter ..... 75/53
4,209,325 6/1980 Cooper ..... 75/58
4,217,134 8/1980 Russell ..... 75/58
4,266,969 5/1981 Koros ..... 75/58

*Primary Examiner*—Peter D. Rosenberg
*Attorney, Agent, or Firm*—Balogh, Osann, Kramer, Dvorak, Genova & Traub

[57] ABSTRACT

Injection-desulfurization of a molten iron is carried out in a low cost by using powdery $CaCO_3$ obtained by pulverizing limestone as a desulfurizing agent. This injection-desulfurization also can be attained by using a powdery mixture in which a main ingredient is said powdery calcium carbonate and not more than 30% by weight of powdery quicklime is added thereto, a powdery mixture in which a main ingredient is said powdery calcium carbonate and 5~20% by weight of a carbonaceous material and 2~15% by weight of at least one of halides of alkali and alkaline earth metals are added thereto, or a powdery mixture in which a main ingredient is said calcium carbonate and 5~20% by weight of a carbonaceous material, 2~15% by weight of at least one of halides of alkali and alkaline earth metals and not more than 30% by weight of powdery quicklime are added thereto, as the desulfurizing agent.

4 Claims, 5 Drawing Figures

METHOD FOR DESULFURIZING A MOLTEN IRON BY INJECTION

BACKGROUND OF THE INVENTION

1. Field of the Invention

The present invention relates to a method for desulfurizing a molten iron by injection particularly by using calcium carbonate which has been heretofore considered to be low in the desulfurizing ability or to lower said function as a desulfurizing agent. The term "desulfurization by injection" is expressed by "injection-desulfurization" hereinafter.

2. Description of the Prior Art

Prior desulfurizing agents used in the injection- desulfurization of a molten iron are mainly calcium carbide or quicklime (CaO). Among them, calcium carbide has been most broadly used because of a high reaction efficiency and a small used amount. However, calcium carbide is usually produced by reacting mixture of quicklime and coke in an electric furnace, so that calcium carbide is high in cost and therefore, a desulfurizing agent consisting mainly of quicklime has been recently used instead of calcium carbide.

In the injection-desulfurization using a carrier gas, when powdery calcium carbide or quicklime is used, it is necessary to mix a small amount of calcium carbonate or other gas-forming substances in order to promote the stirring of the molten bath. However, calcium in calcium carbonate has been considered to be an ingredient which does not serve to the desulfurizing reaction, because this compound is decomposed to form $CO_2$ and the reaction site becomes an oxidizing atmosphere and therefore calcium carbonate is only used as a desulfurizing aid, and the used amount is limited to the necessary lowest amount. Accordingly, it has never been intended to use calcium carbonate alone as the main active ingredient.

SUMMARY OF THE INVENTION

It has been found that when the above described powdery calcium carbonate which has been heretofore considered not to serve to the desulfurizing reaction, is used for the injection-desulfurization wherein a carrier gas is used, the powdery calcium carbonate acts satisfactorily effectively to the desulfurization and according to the present invention, a novel method for injection-desulfurizing a molten iron has been developed by means of an inexpensive desulfurizing agent having a high desulfurizing ability.

That is, the first aspect of the present invention is characterized in that in the desulfurization of a molten iron wherein a desulfurizing agent is directly injected into the molten iron by using a carrier gas, powdery calcium carbonate obtained by pulverizing limestone is used as the desulfurizing agent.

The second aspect of the present invention lies in that a mixture wherein powdery calcium carbonate obtained by pulverizing limestone is the main ingredient and not more than 30% by weight of powdery quicklime is added thereto, is used as the desulfurizing agent.

The third aspect of the present invention lies in that a mixture wherein powdery calcium carbonate obtained by pulverizing limestone is the main ingredient and 5~20% by weight of a carbonaceous material and 2~15% by weight of at least one of halides of alkali and alkaline earth metals are added thereto, is used as the desulfurizing agent.

The fourth aspect of the present invention lies in that a mixture wherein calcium carbonate obtained by pulverizing limestone is the main ingredient and 5~20% by weight of a carbonaceous material, 2~15% by weight of at least one halides of alkali and alkaline earth metals and not more than 30% by weight of powdery quicklime are added thereto, is used as the desulfurizing agent.

BRIEF DESCRIPTION OF THE DRAWINGS

The invention will now be described with reference to the accompanying drawings, wherein.

Figure 3:
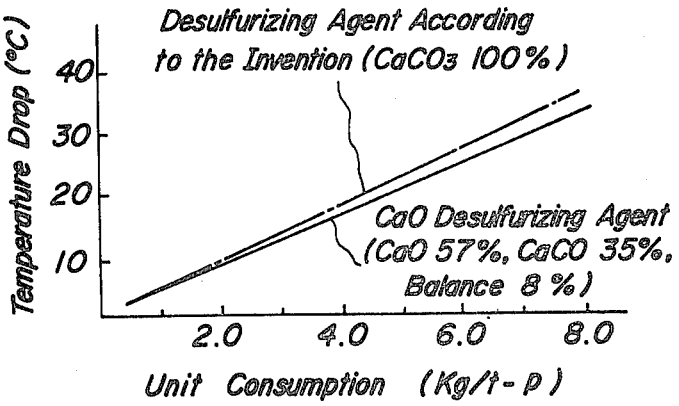
Figure 4:
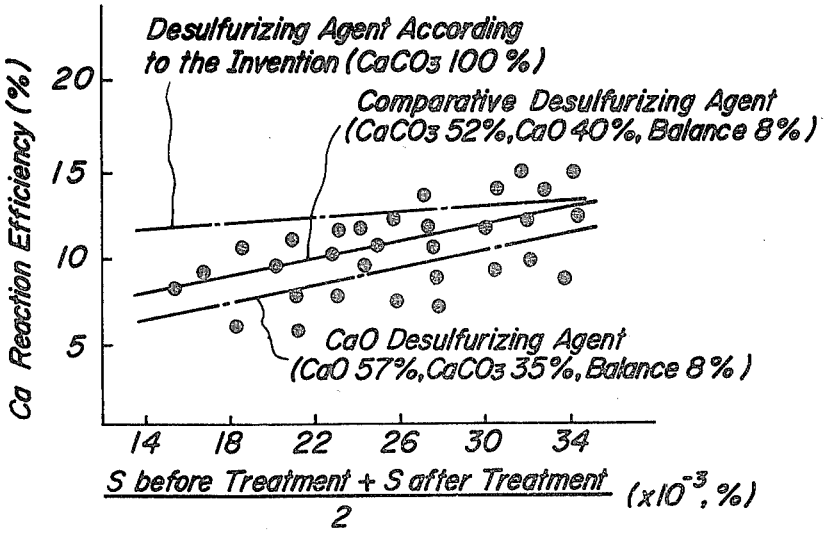
Figure 5:
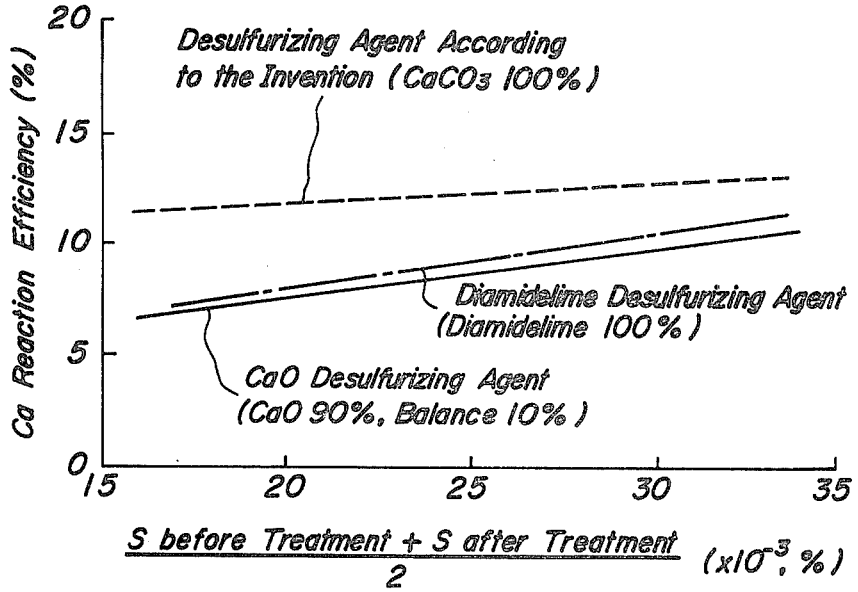

in molten iron and a Ca reaction efficiency in the desulfurizing agent according to the invention;

FIG. 3 is a graph showing a comparison between the desulfurizing agents according to the invention and the prior art on temperature drop during desulfurization treatment;

FIG. 4 is a graph showing a relation between an average sulfur concentration of $$\frac{\text{S before treatment} + \text{S after treatment}}{2} \ (\times 10^{-3}, \%)$$

in molten iron and a Ca reaction efficiency in the desulfurizing agent as a comparative example; and FIG. 5 is a graph showing the Ca reaction efficiency in the desulfurizing agents according to the invention and the prior art.

DESCRIPTION OF THE PREFERRED EMBODIMENTS

In general, it has been considered that calcium carbonate is not preferable as the desulfurizing agent, because said compound is low in the desulfurizing ability and causes a temperature drop due to endotherm owing to the thermal decomposition in the following reaction $$CaCO_3 \rightarrow CaO + CO_2 - 430 \text{ KCal/kg-}CaCO_3 \quad (1)$$

and the reaction site becomes an oxidizing atmosphere owing to the formed $CO_2$.

While, the inventors have found the following novel facts that when powdery calcium carbonate obtained by pulverizing naturally produced limestone is applied to the injection-desulfurization in which a carrier gas is used, the above described presumption is completely reverse.

Figure 1:
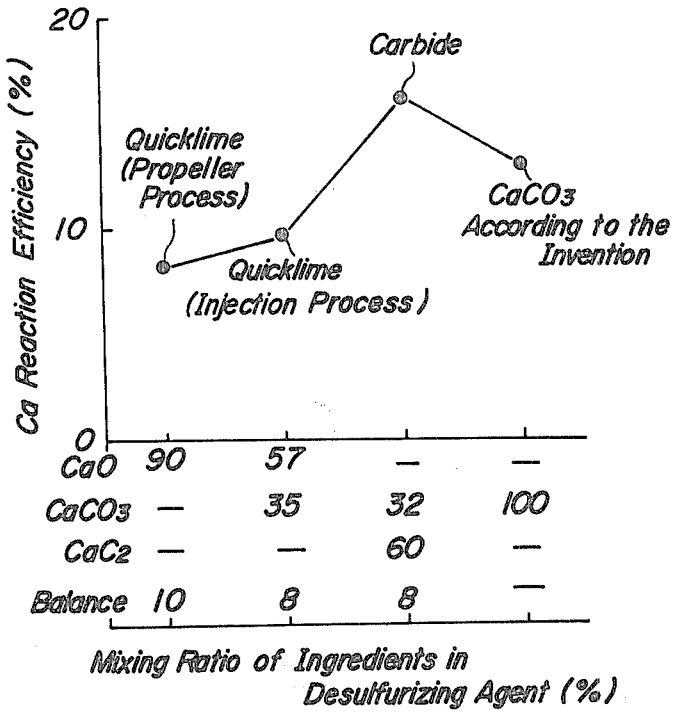
FIG. 1 is a graph showing a relation between a desulfurizing agent and a Ca reaction efficiency.

(1) When powdery calcium carbonate obtained by pulverizing limestone is injected into a molten iron together with a carrier gas, a thermal decomposition is caused to form CaO, which serves to the desulfurizing reaction. Ca reaction efficiency in this case is shown in FIG. 1 and as seen from this result, calcium carbonate according to the present invention shows the better result than quicklime.

Ca reaction efficiency (%) =

-continued $$\frac{(\text{S\% before treatment} - \text{S\% after treatment}) \times \frac{40}{32}}{\text{Used amount (kg/t)} \times \Sigma} \times 10^3$$

$$\Sigma = \left( CaC_2\% \times \frac{40}{64} + CaO\% \times \frac{46}{56} + CaCO_3\% \times \frac{40}{100} \right) \times \frac{1}{100}$$

Figure 2:
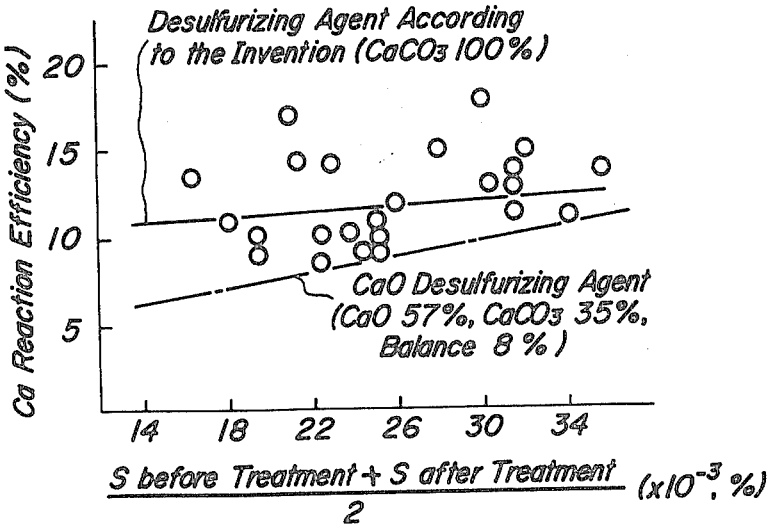
FIG. 2 is a graph showing a relation between an average sulfur concentration of $$\frac{\text{S before treatment} + \text{S after treatment}}{2} \ (\times 10^{-3}, \%)$$

As shown in FIG. 2 in which the blank dots show the result of the desulfurizing agent of 100% of $CaCO_3$ and the solid line shows the regression line, at any point within the range of S concentration in the molten iron, powdery calcium carbonate obtained by pulverizing limestone is higher in the desulfurizing activity than the quicklime base desulfurizing agent (CaO:57%, $CaCO_3$:35%, balance:8%) and particularly, in the low S concentration region, the desulfurizing activity of calcium carbonate is noticeable.

(2) The temperature drop during the treatment is not substantially different between the desulfurizing agent consisting of calcium carbonate alone and the quicklime base desulfurizing agent (CaO:57%, $CaCO_3$:35%, balance:8%) as shown in FIG. 3. In this point, if only the decomposition reaction of the above described equation (1) occurs, there should be difference in the temperature drop of the molten iron but in the inventor's study, the difference has not been found. This is presumably based on the following reason, that is it seems that the reaction of the following equation (2) occurs in the molten iron.

$$2CaCO_3 + Si \rightarrow 2CaO + 2CO + SiO_2 - 55 \text{ Kcal/kg-}CaCO_3 \quad (2)$$

As mentioned above, it can be seen that in the desulfurization system wherein a powdery desulfurizing agent is injected with a carrier gas, even the desulfurizing agent consisting mainly of calcium carbonate can attain unexpectedly the satisfactory desulfurizing activity without causing an extreme temperature drop. Furthermore, in the desulfurizing method of the present invention, the stable desulfurizing treatment can be carried out in a low cost. If the evaluation of this low cost is calculated in the energy unit consumption, said evaluation is as follows.

$CaCO_3$ : (only pulverizing energy): $1.7 \times 10^3$ Kcal/t-$CaCO_3$

CaO: (pulverizing energy + roasting energy): $1{,}152 \times 10^3$ Kcal/t-CaO $CaC_2$ : (pulverizing energy + CaO-roasting energy + electric furnace energy + coke-energy): $8{,}491 \times 10^3$ Kcal/t-$CaC_2$ Note: Pulverizing energy means energy for pulverizing limestone.

Table 2 attached hereinafter shows the data of unit consumption, unit consumption per ΔS (S before treatement - S after treatment), energy per ΔS and temperature drop of the desulfurizing agents of the present invention and comparative examples. As seen from this table, the energy cost of the desulfurization method of the present invention is noticeably better than that of the prior desulfurization methods.

The reason why calcium carbonate ($CaCO_3$) obtained by pulverizing limestone shows smaller unit consumption per ΔS (kg/t/ΔS%) than usual CaO base desulfurizing agents while the desulfurizing efficiency of said calcium carbonate being the same degree as that of usual CaO-desulfurizing agents in the reaction with the molten iron, is considered to rely upon that the reaction area of said calcium carbonate is larger than that of CaO in the usual desulfurizing agents.

That is, even if $CaCO_3$ penetrates into the molten iron in the same grain size, $CaCO_3$ is explosively fractured upon the thermal decomposition, so that the grain size becomes fine and the specific surface area of $CaCO_3$ becomes larger than that of quicklime (CaO). When quicklime base desulfurizing agents are used, it is preferable to use the more fine grain size but in this case, CaO particles are difficult in separation from the carrier gas, so that the contact with the molten iron is prevented and the desulfurizing efficiency becomes poor.

In the low sulfur concentration region, the desulfurizing method of the present invention using $CaCO_3$ is particularly higher in the desulfurizing activity and this is presumably based on the following reason. That is, an amount of gas formed from $CaCO_3$ is high and the stirring of the molten iron is vigorous and the transfer of S in the molten iron site, which is the rate controlling step in the low concentration region of sulfur, is increased.

On the other hand, $CaCO_3$ is higher in the amount of gas formed and therefore there is such a risk that the splash increases or the formation of the CO rich exhaust gas increases. Accordingly, there may be the case where the desulfurizing agent consisting of $CaCO_3$ alone cannot be used. For overcoming such a problem, a mixture in which not more than 30% by weight of CaO the range of which does not decrease the activity of the present invention, is added, is used.

When the amount of CaO exceeds 30% by weight, the characteristic merit of the present invention which is cheap, is lost and further the high Ca reaction efficiency at the low sulfur concentration region is lost as shown in FIG. 4, in which the black dots show the results of the comparative desulfurizing agent ($CaCO_3$:52%, CaO:40%, balance: 8%) and the solid line shows the regression line thereof.

Furthermore, Ca reaction efficiency may be improved by adding at least one of halides of alkali and alkaline earth metals, such as fluorite, NaF, $MgF_2$, cryolite, etc. to promote the slag formation, and/or a carbonaceous material, such as coke which acts to make the atomsphere reductive. With respect to the amount of the halides of alkali and alkaline earth metals added, explanation will be made. When said amount is less than 2%, the activity for promoting the slag formation cannot be attained, while when said amount is more than 15%, even if Ca reaction efficiency is increased, the entire unit consumption of the desulfurizing agent is not varied and rather increases and the desulfurization cost rises. With respect to the carbonaceous material, the amount of less than 5% is low in the activity which makes the atmosphere reductive and Ca reaction efficiency cannot be improved. While, when said amount exceeds 20%, even if Ca reaction efficiency is increased, the entire unit consumption of the desulfurizing agent is increased and the cost rises.

As the calcium carbonate usable in the invention, there may be considered by-products in chemical industry such as carbon-containing calcium carbonate or a so-called diamidelime, which is obtained as a by-produced filter residue in the production of dicyandiamide and used as a desulfurizing agent in the injection-desulfurization, and the like in addition to powdery calcium carbonate obtained by pulverizing naturally produced limestone. According to the invention, however, the powdery calcium carbonate of natural limestone is preferably used.

In FIG. 5 are shown comparative results of the powdery calcium carbonate according to the invention with the powdery diamidelime and quicklime according to the prior art on the Ca reaction efficiency. As apparent from FIG. 5, when using the powdery diamidelime alone as a desulfurizing agent, the Ca reaction efficiency is only obtained at substantially the same level as in the quicklime desulfurizing agent (CaO:90%, balance:10%), while when the powdery calcium carbonate of natural limestone according to the invention is used alone as a desulfurizing agent, the Ca reaction efficiency is improved considerably.

As a result of our studies, the reason why there is a difference in the Ca reaction efficiency between the powdery calcium carbonate and the powdery diamidelime as described above is considered to result from the following three points:

(1) The powdery diamidelime is spherical, while the powdery calcium carbonate of natural limestone is plate and is apt to be fractured;

(2) In the powdery calcium carbonate, the surface molecular structure is changed from calcite into aragonite of higher energy state by pressure loading and frictional heat during the pulverization, so that the activity of the powdery calcium carbonate is fairly higher than that of the powdery diamidelime; and (3) The powdery diamidelime contains 2~5% of $SiO_2$ as an impurity, which frequently forms a phase of $2CaO.SiO_2$ having a small diffusion coefficient of S and obstructs the desulfurization reaction.

The injection-desulfurization of molten iron was carried out in a torpedo car of 350 ton capacity by using a desulfurizing agent as shown in the following Table 1 to obtain results as shown in the following Table 2.

TABLE 1

| Desulfurizing agent No. | | Mixing ratio of ingredients in desulfurzing agent: Powdery calcium carbonate (naturally produced limestone) | Diamidelime | Quicklime (CaO) | Carbide | Carbonaceous substance | Fluorite |
|---|---|---|---|---|---|---|---|
| Present invention | 1 | 100 | — | — | — | — | — |
| | 2 | 80 | — | 20 | — | — | — |
| | 3 | 93 | — | — | — | 5 | 2 |
| | 4 | 73 | — | 20 | — | 5 | 2 |
| Comparative agent | 5* | 35 | — | 57 | — | 5 | 3 |
| | 6 | 32 | — | — | 60 | 8 | — |
| | 7 | — | 100 | — | — | — | — |
| | 8 | — | 80 | 20 | — | — | — |
| | 9 | — | 73 | 20 | — | 5 | 2 |

*Japanese Patent laid open No. 55-110,712

TABLE 2

| | No. | Desulfurizing agent No. | S before treatment (%) | S after treatment (%) | Amount of molten iron treated (ton) | Carrier gas (Nl/kg) | Injection pressure (kg/cm²) | Unit consumption (kg/t) | Unit consumption/ΔS (kg/t/S %) | Energy*/ΔS (Kcal/t/S %) | Temperature drop ΔT (°C.) |
|---|---|---|---|---|---|---|---|---|---|---|---|
| Example | 1 | 1 | 0.042 | 0.013 | 283 | 7 | 2.7 | 5.8 | 200 | 455 | 27 |
| | 2 | 2 | 0.047 | 0.014 | 276 | 6 | 2.6 | 6.9 | 209 | 47,619 | 33 |
| | 3 | 3 | 0.051 | 0.016 | 278 | 6 | 2.6 | 6.7 | 191 | 303 | 32 |
| | 4 | 4 | 0.039 | 0.013 | 280 | 6 | 2.5 | 4.9 | 188 | 43,478 | 22 |
| | 5 | 1 | 0.046 | 0.001 | 281 | 7 | 2.5 | 12.2 | 271 | 455 | 50 |
| | 6 | 2 | 0.037 | 0.001 | 279 | 7 | 2.5 | 10.6 | 294 | 71,429 | 47 |
| | 7 | 3 | 0.038 | 0.001 | 278 | 6 | 2.7 | 9.5 | 257 | 417 | 42 |
| | 8 | 4 | 0.044 | 0.001 | 282 | 7 | 2.6 | 10.5 | 244 | 58,824 | 45 |
| Comparative Example | 9 | 5 | 0.041 | 0.013 | 277 | 6 | 2.7 | 7.0 | 250 | 166,667 | 33 |
| | 10 | 6 | 0.039 | 0.014 | 282 | 7 | 2.5 | 3.3 | 132 | 666,667 | 18 |
| | 11 | 7 | 0.041 | 0.013 | 280 | 6 | 2.6 | 7.3 | 260 | 592 | 35 |
| | 12 | 8 | 0.042 | 0.012 | 278 | 6 | 2.6 | 7.4 | 248 | 57,354 | 33 |
| | 13 | 9 | 0.040 | 0.012 | 281 | 7 | 2.6 | 6.9 | 246 | 56,891 | 30 |
| | 14 | 5 | 0.038 | 0.003 | 283 | 7 | 2.6 | 13.0 | 371 | 243,902 | 53 |
| | 15 | 6 | 0.043 | 0.003 | 279 | 6 | 2.6 | 11.5 | 288 | 1,470,588 | 48 |
| | 16 | 7 | 0.039 | 0.002 | 281 | 7 | 2.5 | 13.0 | 350 | 588 | 53 |
| | 17 | 8 | 0.041 | 0.002 | 283 | 6 | 2.5 | 14.0 | 359 | 87,221 | 62 |
| | 18 | 9 | 0.039 | 0.003 | 278 | 6 | 2.7 | 13.2 | 367 | 88,477 | 57 |

*The term "energy" means a total energy value required for the production of the desulfurizing agent.

In Table 2, Examples 1 to 4 and Comparative Examples 9 to 13 show results in the production of molten iron having a low sulfur concentration with the use of the desulfurizing agent as shown in Table 1, respectively, while Examples 5 to 8 and Comparative Examples 14 to 18 show results in the production of molten steel having an extremely low sulfur concentration ($S \leqq 0.003$) with the use of the desulfurizing agent as shown in Table 1.

As apparent from Table 2, when Example 1 is compared with Comparative Example 9, the desulfurizing agent according to the invention is high in the desulfurization efficiency (unit consumption/ΔS) and cheap in the cost. When Example 1 is compared with Comparative Example 10, the desulfurization efficiency is low, but the unit consumption required for obtaining the same desulfurizing effect is about two times that of Comparative Example 10, which shows a great desulfurizing effect considering that the unit price of the powdery calcium carbonate in Example 1 is usually about 1/6 of that of the carbide in Comparative Example 10. In Comparative Examples 11 to 13, the desulfurization efficiency is about 75%~85% of those Examples 1 to 4.

On the other hand, when Examples 5 to 8 are compared with Comparative Examples 14 to 18, the value of S=0.001% is achieved in all of Examples 5 to 8, while it is difficult to achieve the value of S=0.001% in all of Comparative Examples 14 to 18 because the value of S=0.002% is only achieved in case of the quicklime and carbide desulfurizing agents and the value of S=0.003% is only achieved in case of the diamidelime desulfurizing agent. Furthermore, there is substantially no difference in the unit consumption between Examples 5 to 8 and Comparative Example 15, from which it is obvious that the effect of desulfurizing to an extremely low sulfur concentration is large in Examples 5 to 8. Moreover, it is apparent that the temperature drop is small in Examples 5 to 8 rather than in Comparative Examples 14 to 18.

As mentioned above, according to the invention, the desulfurization of molten iron can be performed in a lower cost, and particularly a higher desulfurization efficiency can be obtained on molten iron having a lower sulfur concentration.

What is claimed is:

1. A method for desulfurizing a molten iron by injection in which a powdery desulfurizing agent is directly injected into the molten iron by using a carrier gas, which comprises using only powdery calcium carbonate obtained by pulverizing limestone as the desulfurizing agent.

2. A method for desulfurizing a molten iron by injection in which a powdery desulfurizing agent is directly injected into the molten iron by using a carrier gas, which comprises using a powdery mixture in which a main ingredient is powdery calcium carbonate obtained by pulverizing limestone and not more than 30% by weight of powdery quicklime is added thereto, as the desulfurizing agent.

3. A method for desulfurizing a molten iron by injection in which a powdery desulfurizing agent is directly injected into the molten iron by using a carrier gas, which comprises using a powdery mixture in which a main ingredient is powdery calcium carbonate obtained by pulverizing limestone and 5~20% by weight of a carbonaceous material and 2~15% by weight of at least one of halides of alkali and alkaline earth metals are added thereto, as the desulfurizing agent.

4. A method for desulfurizing a molten iron by injection in which a powdery desulfurizing agent is directly injected into the molten iron by using a carrier gas, which comprises using a powdery mixture in which a main ingredient is calcium carbonate obtained by pulverizing limestone and 5~20% by weight of a carbonaceous material, 2~15% by weight of at least one of halides of alkali and alkaline earth metals and not more than 30% by weight of powdery quicklime are added thereto, as the desulfurizing agent.

* * * * *